US009677756B1

(12) United States Patent
Johnson

(10) Patent No.: US 9,677,756 B1
(45) Date of Patent: Jun. 13, 2017

(54) CURIO DOOR

(71) Applicant: Steve M. Johnson, Cordova, TN (US)

(72) Inventor: Steve M. Johnson, Cordova, TN (US)

( * ) Notice: Subject to any disclaimer, the term of this patent is extended or adjusted under 35 U.S.C. 154(b) by 0 days.

(21) Appl. No.: 14/215,689

(22) Filed: Mar. 17, 2014

Related U.S. Application Data

(60) Provisional application No. 61/793,556, filed on Mar. 15, 2013.

(51) Int. Cl.

| | |
|---|---|
| ***F21S 8/00*** | (2006.01) |
| ***F21V 33/00*** | (2006.01) |
| ***E06B 7/28*** | (2006.01) |
| ***F21K 99/00*** | (2016.01) |

(52) U.S. Cl.
CPC ..... *F21V 33/006* (2013.01); *E06B 7/28* (2013.01); *F21K 9/30* (2013.01); *F21V 33/0056* (2013.01)

(58) Field of Classification Search
CPC ..... F21K 9/30; F21V 33/00; F21V 33/0016; F21V 33/0056
USPC ..... 362/145
See application file for complete search history.

(56) References Cited

U.S. PATENT DOCUMENTS

| | | | | | |
|---|---|---|---|---|---|
| 2,256,670 | A * | 9/1941 | Greenlees | E05B 17/10 | 200/314 |
| 2,403,491 | A * | 7/1946 | Bogia | A47G 1/0638 | 40/753 |
| 2,765,396 | A * | 10/1956 | Iverson | E05B 17/10 | 200/507 |
| 2,813,195 | A * | 11/1957 | Willey | E05B 17/10 | 362/100 |
| 4,435,743 | A * | 3/1984 | Plumly | G02B 6/0083 | 362/184 |
| 4,821,158 | A * | 4/1989 | Mitten | 362/249.14 | |
| 5,564,294 | A | 10/1996 | Chen | | |
| 5,581,230 | A * | 12/1996 | Barrett | G08B 5/36 | 116/202 |
| 5,943,803 | A | 8/1999 | Zinbarg | | |
| 6,367,204 | B1 * | 4/2002 | Eichler | 52/3 | |
| 6,395,369 | B1 * | 5/2002 | Randone | 428/99 | |
| 6,572,238 | B1 | 6/2003 | Johnson | | |
| 6,736,534 | B1 * | 5/2004 | Fite | 362/576 | |
| 8,021,009 | B2 * | 9/2011 | Knoll et al. | 362/92 | |
| 2002/0051356 | A1 * | 5/2002 | Takahashi et al. | 362/31 | |
| 2009/0026355 | A1 * | 1/2009 | Anderson | G08B 13/08 | 250/221 |
| 2009/0284985 | A1 * | 11/2009 | Bita et al. | 362/617 | |
| 2010/0255227 | A1 * | 10/2010 | Hisle | 428/34.1 | |
| 2010/0327720 | A1 * | 12/2010 | Pae | 312/405 | |
| 2011/0255303 | A1 * | 10/2011 | Nichol et al. | 362/606 | |
| 2011/0317448 | A1 * | 12/2011 | Podd | 362/628 | |

OTHER PUBLICATIONS

Ocean View Theme Custom Door Banner (24"×60") http://www.windycitynovelties.com/194933p/ocean-view-theme-customdoorbanner.html?s_cid=FRO194933&utm_source=Froogle&utm_medium=ShopFeed&utm_term=194933&utm_campaign=Froogle Accessed Apr. 25, 2012.

* cited by examiner

*Primary Examiner* — Bryon T Gyllstrom
(74) *Attorney, Agent, or Firm* — Robert C. Montgomery; Montgomery Robert & Design, LP

(57) ABSTRACT

A door having a front face with a transparent portion and a decorative insert set behind. The decorative insert presents a thematic scene as desired by the user that may be easily changed. The door further enhances the display of the decorative insert by providing selectively controlled illumination and an accompanying audio presentation related to the insert's theme.

11 Claims, 3 Drawing Sheets

CURIO DOOR

RELATED APPLICATIONS

The present invention was first described in and claims the benefit of U.S. Provisional Application No. 61/793,556, filed Mar. 15, 2013, the entire disclosures of which are incorporated herein by reference.

FIELD OF THE INVENTION

The present invention relates to a curio door having a transparent surface and a display back-drop, along with electronics to compliment the display theme.

BACKGROUND OF THE INVENTION

Interior decorating incorporates a wide variety of styles, borrowing ideas from cultures across the globe in order to achieve a unique, signature style for the home or space being decorated. Those who are on the cutting edge of modern interior decorating practices know all too well that interior design is susceptible to the same trends or cyclical popularity as that experienced in fashion and other areas. One (1) important factor of many decorated rooms is that of the door itself, as its presence may remain unchanged during consecutive remodeling projects and may even remain unchanged for the life of the structure. In response to this constant evolution of interior design methods, interior designers and manufacturers of interior design articles are constantly tasked to produce new and innovative ideas. These designers and homeowners want the ability to achieve a popular, yet unique and easily changeable decorative room appearance. Therefore, there is a need to provide not only new decorative ideas, but also a way in which new designs can be employed without a complete redecoration of the living or working space.

SUMMARY OF THE INVENTION

The disadvantages of the prior art are overcome by the present invention in providing a door comprising a front face having a first panel with a transparent portion disposed therein. The door further includes a rear face defined as an opaque second panel. A decorative insert is disposed between the first panel and the second panel so that the insert is visually displayed to a viewer through said transparent portion. A light shelf is disposed on the front panel that is adapted to illuminate the decorative insert.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
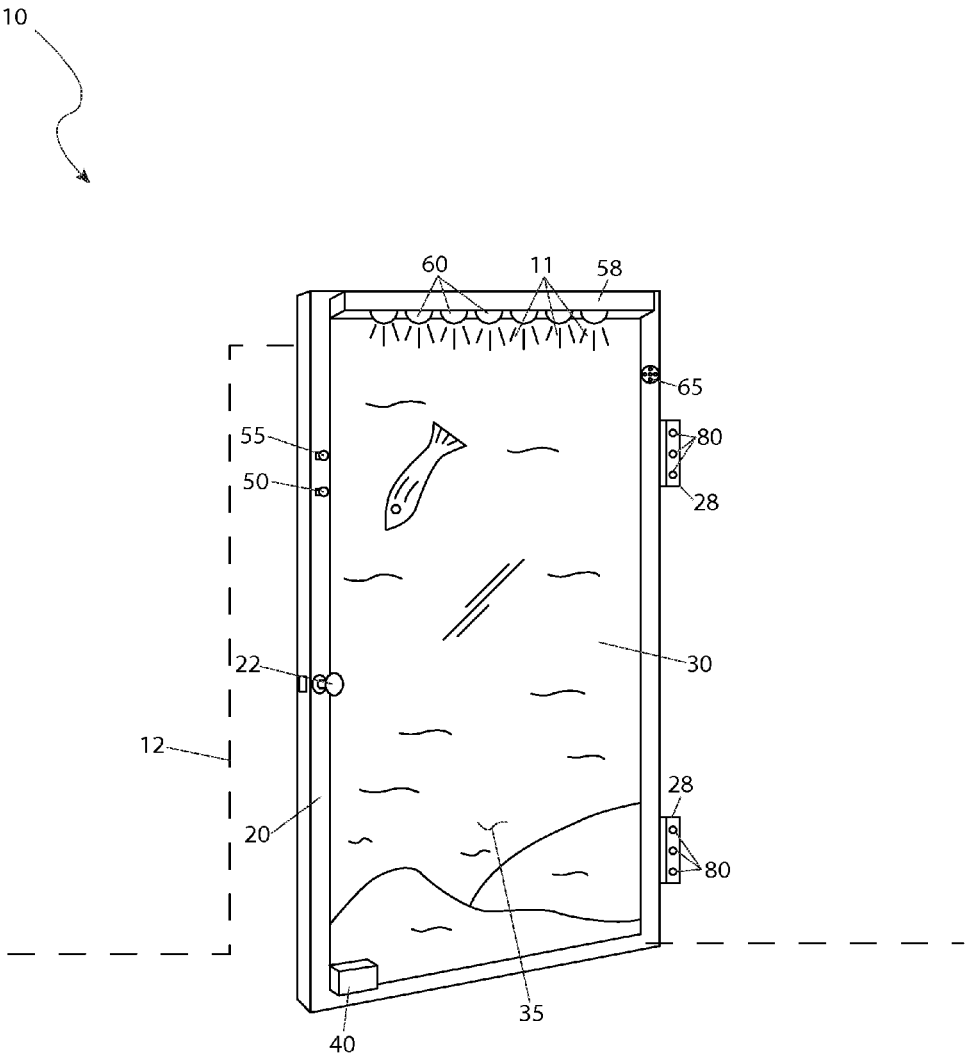
FIG. 1 is a perspective view of a decorative door 10 depicting a first panel 20, according to a preferred embodiment of the present invention.

10 decorative door
11 illumination
12 doorway
20 first panel
22 first door knob
24 second panel
26 second door knob
28 hinge
30 transparent portion
35 decorative scene
40 battery compartment
45 battery
50 on/off switch
55 volume switch
57 enhancement circuitry
58 light shelf
60 lamp
65 speaker
70 electrical wiring
80 fastener

DETAILED DESCRIPTION OF THE PREFERRED EMBODIMENT

Figure 2:
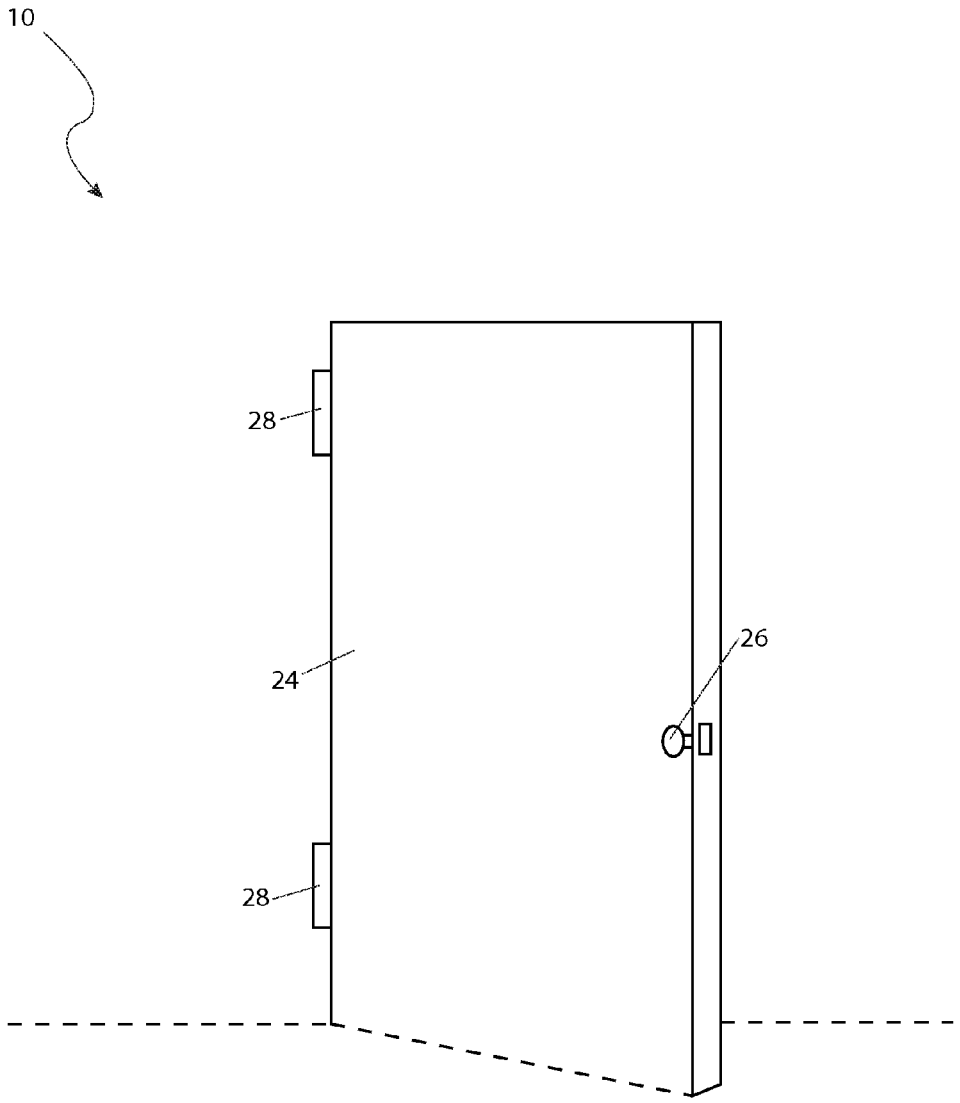
FIG. 2 is another perspective view of the decorative door 10 depicting an second panel 24, according to a preferred embodiment of the present invention; and, FIG. 3 is an electrical block diagram of the decorative door 10, according to a preferred embodiment of the present invention.
Figure 3:
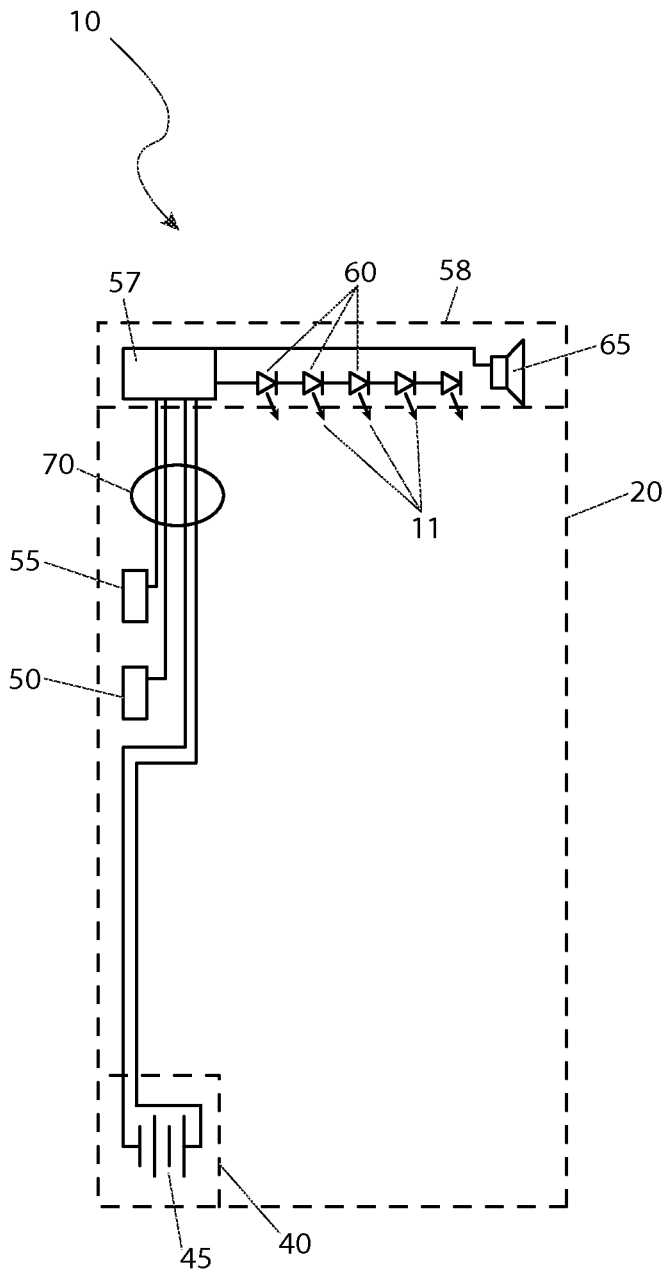

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a decorative door (herein described as the "apparatus") 10, which provides an entertaining theme display to a doorway 12, further having a transparent first panel 20 covering a decorative insert 35, and an opaque second panel 24.

Referring now to FIG. 1, a perspective view of the apparatus 10 depicting a first panel 20, according to the preferred embodiment of the present invention, is disclosed. The apparatus 10 is placed within a doorway 12 of a desired room being pivotingly secured using plurality of hinges 28 and corresponding fasteners 80 in a conventional manner. Although illustrated as having two hinges 28, it should be appreciated that the attachment of the apparatus 10 to a door frame may require more than two hinges or comprise a singular piano style hinge without limitation. The apparatus 10 is envisioned to comprise various dimensions to accommodate various sizes of doorways 12. The apparatus 10 is attached to a side portion of the doorway 12, thereby enabling the apparatus 10 to operate in a swinging manner. The apparatus 10 having a front face which is oriented to provide a visual display to an observer that is defined as a first panel 20 and a rear face defined as a second panel 24.

The first panel 20 of the apparatus 10 includes an first door knob 22 being in mechanical communication with an internal latch and an second door knob 26 (see FIG. 2) which enables a user to latch or open and close the apparatus 10 within the doorway 12 from either side in a similar manner as a normal door. The first door knob 22 is envisioned to be a convention door knob latching device, yet it is known that other similar devices may be utilized without limiting the scope of the apparatus 10.

The first panel 20 provides a rectangular transparent portion 30 made preferably of a PLEXIGLAS®, LEXAN®, or similar transparent material which enables clear viewing of a decorative insert 35 which is inserted between the transparent portion 30 and the opaque second panel 24, or may be adhesively or otherwise affixed to the transparent portion 30 (see FIG. 2). The decorative insert 35 is envisioned being made using a poster board panel or an equivalent material and envisioned to be entirely covered by a realistic or photographic image. The decorative insert 35 are envisioned being introduced depicting attractive themes such as, but not limited to: aquatic, landscape, a personal photograph, animals, flowers, and the like, based upon a user's preference.

Additionally, the first panel 20 provides a means to provide illumination 11 of the internal decorative insert 35 via a light shelf 58 located along an upper edge portion. The light shelf 58 provides a permanently mounted box-like structure which extends across a top edge of the first panel 20 having a bottom surface portion which protrudes perpendicularly outward from the transparent portion 30. The light shelf 58 includes a plurality of lamps 60 arranged along a bottom surface portion, which provide downwardly directed illumination 11 which passes through the transparent portion 30 and onto the decorative insert 35. The lamps 60 are depicted as being positioned along an upper perimeter edge to enable the illumination 11 to shine upon the decorative insert 35; however, it is understood that the lamps 60 may be positioned upon other perimeter portions of the first panel 20 without limiting the scope of the apparatus 10. Although FIG. 1 illustrates the decorative insert 35 as an aquatic underwater scene, it should be appreciated that the apparatus 10 is structured to allow the selective replacement of a currently installed decorative insert 35 with any other decorative insert 35 that may depict any other theme or themes as the user desires without limiting the scope or deviating from the teachings of the apparatus 10.

The first panel 20 of the apparatus 10 includes electrical components which power and control the lamps 60, as well as providing broadcasted sound, these components include a battery compartment 40, an on/off switch 50, a volume switch 55, enhancement circuitry 57 which comprises a microprocessor-based circuit board, and an audio speaker 65 (also see FIG. 3). The battery compartment 40 is integrated into, or otherwise mounted, along a bottom portion of the first panel 20, and is to provide a means of access for changing an internal battery 45. The on/off switch 50 activates the apparatus 10 and powers the illumination 11 and sound functions. The volume switch 55 is preferably a rotary selector switch which adjusts a broadcasting volume of pre-programmed melodies, nature sounds, narrated stories, and the like, which may be broadcasted from the speaker 65 to enhance presentation of the theme when desired. The on/off switch 50 and volume switch 55 are preferably mounted conveniently upon the first panel 20.

The enhancement circuitry 57 is to be capable of storing a plurality of pre-recorded melodies, nature sounds, narrated stories, and the like, being stored within digital memory portions of the microprocessor-based circuit board and are broadcast in conjunction with the decorative insert 35, combining to enhance the presentation of the theme. Once initiated by the on/off switch 50, the enhancement circuitry 57 broadcasts the aforementioned sounds by conducting an output current to drive the speaker 65. The speaker 65 is depicted here being mounted to an upper side surface of the first panel 20 opposite the switches 50, 55, yet it is understood that other positions of the switches 50, 55 and the speaker 65 may be utilized without limiting the scope of the apparatus 10.

Referring now to FIG. 2, a perspective view of the apparatus 10 depicting a second panel 24, according to the preferred embodiment of the present invention, is disclosed. The second panel 24 of the apparatus 10 is comprised of a solid opaque material such as wood, a composite material, or the like, thereby prohibiting viewing of the entertaining decorative insert 35 disposed upon the first panel 20. It is envisioned that the second panel 24 be fabricated in various colors, patterns, or styles to accommodate an existing interior décor. The second panel 24 includes a second door knob 26 along an intermediate side edge which provides normal unlatching and opening of the apparatus 10. The second door knob 26 is envisioned to be a convention door knob latching device, yet it is known that other similar devices may be utilized without limiting the scope of the apparatus 10.

Referring now to FIG. 3, an electrical block diagram of the apparatus 10, according to the preferred embodiment of the present invention, is disclosed. The battery 45 is mounted within the battery compartment 40 and supplies the apparatus 10 with current to power the illumination 11, the enhancement circuitry 57, and the speaker 65. The battery 45 is preferably a common user replaceable electro-chemical cell interconnected to the electrical components of the apparatus 10 via electrical wiring 70 and may be a singular battery or a plurality. The electrical wiring 70 is envisioned to be routed between decorative insert 35 (see FIG. 1) and the second panel 24 (see FIG. 2) and be appropriately gauged for an electrical current necessary to power the apparatus 10.

The lamps 60 are envisioned to be light-emitting diodes (LED) or another current illumination technology, and introduced in various illuminating colors and capable of sequential operation as directed by the enhancement circuitry 57 to change the pattern of the illumination 11. The lamps 60 are controlled via the electrically interconnected on/off switch 50. The on/off switch 50 is envisioned to be a common sliding or pushbutton-type switching device, yet it is known that other devices may be utilized without limiting the scope of the apparatus 10. The speaker 65 is envisioned to be an electro-acoustical transducer type, or other current speaker technology, capable of broadcasting the pre-programmed melodies stored within the microprocessor-based circuit board of the enhancement circuitry 57. The output of the speaker 65 is controlled via the volume switch 55. The volume switch 55 is envisioned to be a common rotatable switching device, yet it is known that other devices may be utilized with equal benefit without limiting the scope of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring a model of the apparatus 10 having desired height and width dimensions to fit an intended doorway 12, and having a desired decorative insert 35; positioning the apparatus 10 within the doorway 12 with a first panel 20 facing toward an area where it is desired to view the decorative insert 35; attaching the apparatus 10 to the doorway 12 in a pivoting manner using the hinges 28 and corresponding fasteners 80 such as screws or bolts with; placing fresh batteries 45 within the battery compartment 40; initiating the sound and illumination 11 features of the apparatus 10 by motioning the on/off switch 50 to an "on" position; rotating the volume switch 55 to produce a desired broadcasted volume through the speaker 65; utilizing the door knobs 22, 26 to provide normal opening and closing functions of the apparatus 10 to access a room, as desired; and, enjoying the entertaining illuminated visual effects and broadcasted audio effects afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A door, comprising:
a door frame;
a transparent first panel attached to said door frame;
an opaque second panel attached to said door frame;
a decorative insert disposed between said first panel and said second panel;
a light shelf on said door and extending away from said first panel, said light shelf including a light source for illuminating said decorative insert through said first panel;
an electrical power supply attached to a bottom of said door frame;
a first control switch on said door frame for receiving electrical power from said electrical power supply;
a second control switch on said door frame;
a digital memory storing a digitized version of an audio signal; and,
at least one speaker attached to said door frame and in electrical communication with said electrical power supply, said second control switch, and said digital memory;
wherein said at least one speaker provides an audio output based on said digitized version of an audio signal when said second control switch is closed;
wherein said light source selectively receives electrical power from said first control switch; and,
wherein said decorative insert is visually displayed to a viewer.

2. The door of claim 1, further comprises a plurality of hinges to operatively attach said door frame to a doorway.

3. The door of claim 1, further comprising:
a first knob operatively disposed on said door frame; and,
a second knob operatively disposed on said door frame;
wherein said first and said second knob provide a user selective control opening and closing said door.

4. The door of claim 1, wherein said light source comprises a light emitting diode.

5. The door of claim 1, wherein said electrical power supply further comprises at least one battery.

6. A door, comprising:
a door frame;
a front transparent first panel;
a rear second panel;
a decorative insert disposed between said first panel and said second panel;
a plurality of hinges on said door frame;
an illuminating device disposed away from said first panel for illuminating said decorative insert through said first panel;
an electrical power supply attached near a bottom of said door frame;
a first control switch attached to said door frame for selectively connecting said electrical power supply to said illuminating device;
a second control switch attached to said door frame;
a digital memory; and,
a speaker in electrical communication with said electrical power supply, said second control switch, and said digital memory;
wherein said speaker provides an audio output based on data stored in said digital memory when said second control switch is activated;
wherein said illuminating device selectively illuminates said decorative insert as controlled by a user;
wherein said hinges operatively attach said door frame to a doorway; and,
wherein said decorative insert is visually displayed to a viewer through said transparent portion.

7. The door of claim 6, further comprising:
a first knob operatively disposed on said door frame; and,
a second knob operatively disposed on said door frame;
wherein said first and said second knobs cooperatively provide a user selective control of opening and closing said door.

8. The door of claim 6, wherein said illuminating device comprises a light emitting diode.

9. A door, comprising:
a door frame;
a front transparent first panel attached to said door frame;
a rear opaque second panel attached to said door frame;
a decorative insert disposed between said first panel and said second panel;
enhancement circuitry operatively attached to said door frame, comprising:
an electrical power supply attached to said door frame;
a first control switch attached to said door frame;
a second control switch attached to said door frame;
a digital memory;
at least one speaker in electrical connection with said electrical power supply through said first control switch and with said digital memory; and,
a light shelf extending away from said first panel and comprising at least one lamp in electrical connection with said electrical power supply via said second control switch;
wherein said at least one speaker provides an audio output when activated by said first control switch; and,
wherein said decorative insert is illuminated by said light shelf when said second control switch as activated; and,
a plurality of hinges attached to said door frame;

wherein said enhancement circuitry is adapted to illuminate said decorative insert by passing light through said first panel onto said decorative insert and to provide an audio output.

10. The door of claim 9, further comprising:

a first knob operatively disposed on said door frame; and, a second knob operatively disposed on said door frame;

wherein said first and said second knobs cooperatively provide a user selective control of the opening and closing of said door.

11. The door of claim 9, wherein said at least one lamp comprises a light emitting diode as a light source.

* * * * *